United States Patent [19]

Noguchi et al.

[11] Patent Number: 4,643,626

[45] Date of Patent: Feb. 17, 1987

[54] CARD ITEM STACKER CAPABLE OF READILY TAKING OUT CARD ITEMS

[75] Inventors: Masahiko Noguchi; Kunio Hiromori, both of Tokyo, Japan

[73] Assignee: NEC Corporation, Japan

[21] Appl. No.: 597,162

[22] Filed: Apr. 5, 1984

[30] Foreign Application Priority Data

Apr. 6, 1983 [JP] Japan ..... 58-50946[U]

[51] Int. Cl.[4] ..... B65H 31/06

[52] U.S. Cl. ..... 414/103; 271/215

[58] Field of Search ..... 271/150, 214, 215, 216, 271/178, 181, 213; 414/103

[56] References Cited

U.S. PATENT DOCUMENTS

| | | | |
|---|---|---|---|
| 2,792,218 | 5/1957 | Van Marle | 271/150 X |
| 3,160,293 | 12/1964 | Hennequin | 414/103 |
| 3,817,516 | 6/1974 | Lazzarotti et al. | 271/150 |
| 3,918,704 | 11/1975 | Sugiyama et al. | 271/215 X |
| 4,065,123 | 12/1977 | Arrasmith et al. | 271/215 |
| 4,083,554 | 4/1978 | Moen | 271/149 X |

OTHER PUBLICATIONS

"Powered Document Stacker", IBM Technical Disclosure Bulletin, vol. 20, No. 3, Aug. 1977.

*Primary Examiner*—Robert J. Spar
*Assistant Examiner*—Janice Krizek
*Attorney, Agent, or Firm*—Laff, Whitesel, Conte & Saret

[57] ABSTRACT

A card item stacker comprises a base member having an upwardly directed principal surface for stacking card items in a predetermined direction, an endless belt extended along the base member for conveying stacked card items, and a guide plate for vertically holding the stacked card items. The endless belt has teeth spaced apart on a belt surface. Each of the tooth surfaces of the endless belt has first and second end portions transversely of the predetermined direction. The first end portion leads the second end portion in a conveying sense of the predetermined direction and is more protruded than the second end portion. At least the first end portion is protruded from the principal surface. The guide plate is engaged with two adjacent ones of the teeth while each card item does not fall within the teeth. The card items can be slided in a sense opposite to the conveying sense.

5 Claims, 4 Drawing Figures

CARD ITEM STACKER CAPABLE OF READILY TAKING OUT CARD ITEMS

BACKGROUND OF THE INVENTION

This invention relates to a card item stacker for use in automatically stacking card items along a predetermined direction with each card item directed substantially vertically.

As will later be described with reference to figures of accompanying drawings, a conventional card item stacker of the type described generally comprises a base member for stacking card items fed by a card feeder and a conveyor slidable on the base member for conveying stacked card items in a predetermined sense of a predetermined direction. The conveyor comprises an endless belt which has teeth spaced apart on a belt surface. The card item stacker stacks the card items along the predetermined direction with the card items substantially vertically held on the endless belt. When the card item stacker is filled with the card items, the stacked card items are taken out by hand.

In the conventional card item stacker, lower edges of the stacked card items are often firmly engaged with the teeth. Therefore, all of the stacked card items can not readily and completely be disengaged from the teeth on lifting up the stacked card items.

SUMMARY OF THE INVENTION

It is therefore an object of this invention to provide a card item stacker wherein stacked card items can be readily taken out of the stacker.

It is another object of this invention to provide a card item stacker wherein stacked card items can be taken out by sliding the stacked card items in a predetermined sense in which the card items are stacked.

According to this invention, a card item stacker comprises a base member having a substantially horizontal and upwardly directed principal surface, a first conveyor for successively supplying card items onto the principal surface with each card item directed substantially vertically, a second conveyor comprising an endless belt and teeth which have substantially planar tooth surfaces, respectively, and are spaced apart on the endless belt and movable parallel to the principal surface with the tooth surface at least partly projected upwardly from the principal surface, a guide plate which has an edge portion and is guided along a horizontal axis above the principal surface to be movable around the horizontal axis until the edge portion is positioned between two adjacent ones of the teeth, and means for feeding the endless belt so that the teeth have the tooth surfaces projected upwardly from the principal surface move in a predetermined sense to urge the card items to said guide plate and to make the card items form a stack of the card items received by cooperation of the principal surface and the tooth surfaces of the teeth moving in the predetermined sense. The base member comprises a pair of longitudinal members on both sides of the endless belt with the principal surface defined by the longitudinal members above the endless belt. Furthermore, each of the tooth surfaces having a first and a second end portion, the first end portion leading the second end portion and being more protruded than the second end portion when the tooth having each of the tooth surfaces moves in the predetermined sense.

DESCRIPTION OF THE PREFERRED EMBODIMENTS

Figure 1:
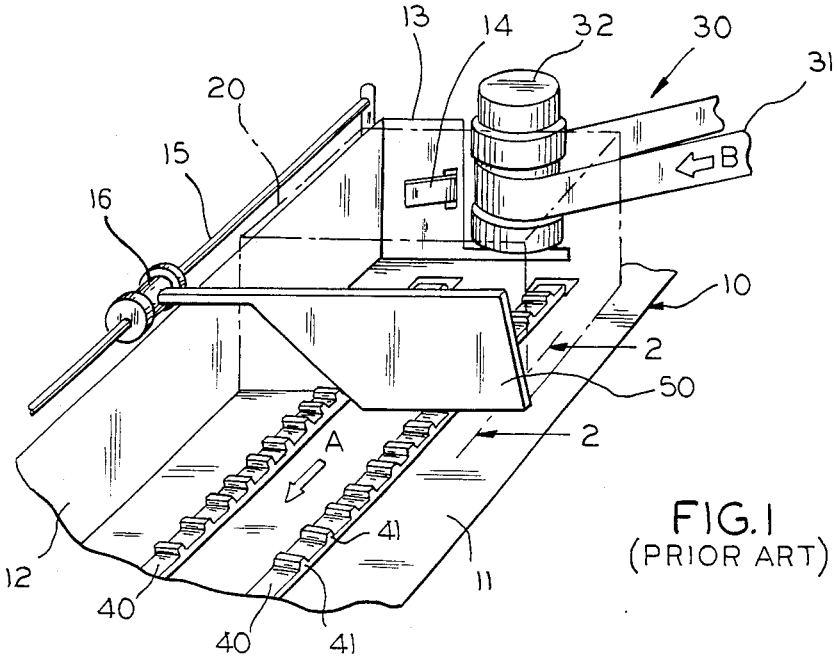
FIG. 1 (PRIOR ART)
FIG. 1 is a perspective view of a conventional card item stacker.

Referring to FIG. 1, description will be made of a conventional card item stacker in order to facilitate an understanding of this invention. The conventional card item stacker is for use in stacking cards (depicted at 20) each of which is sent one by one in a manner to be described.

The card item stacker comprises a base member 10, a card feeder 30 for successively feeding each card to a predetermined area on the base member 10, a pair of endless conveyor belts 40 for conveying the stacked cards 20 in a conveying sense of a predetermined direction, namely, a forward sense of this figure, as indicated by an arrow A, and a guide plate 50 for guiding the stacked cards 20. The stacked cards 20 are held substantially vertically on the conveyor belts 40 by the guide plate 50.

The base member 10 comprises a main plate 11 extended along the predetermined direction which may often be called a conveying direction, a side plate 12 vertically fixed to one side of the main plate 11, and an end plate 13 vertically fixed to one end of the main plate 11 and to the side plate 12. The main plate 11 has a substantially horizontal principal surface. The principal surface is directed to the top of this figure. The side plate 12 is extended along the predetermined direction to support edges of the cards. The end plate 13 substantially vertically holds one of the cards that is placed rearward.

The card feeder 30 includes an endless conveyor belt 31 extended through a roller 32 to form a transport path for each card. The roller 32 is rotatably supported on the base member 10 with its axis directed vertically. The belt 31 is driven in a sense indicated by an arrow B by a rotation imparted to the respective rollers by a driver (not shown). Each of the cards is fed through the transport path and stacked transversely of the conveying direction, namely, the predetermined direction.

Figure 2:
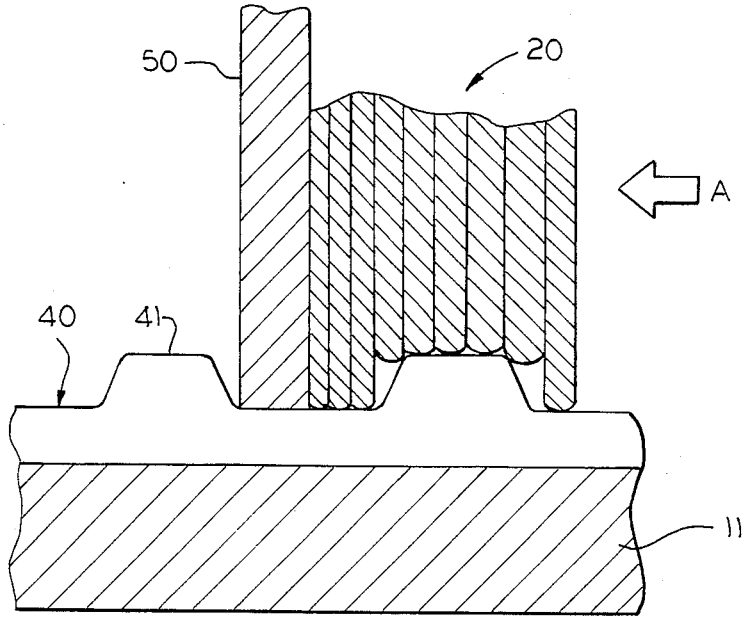
FIG. 2 (PRIOR ART)
FIG. 2 is an enlarged vertical sectional view taken along a line 2—2 in FIG. 1.

The conveyor belts 40 are extended along the main plate 11 in the predetermined direction. Each belt 40 has teeth 41 spaced apart with a recessed portion left between two adjacent ones of the teeth 41, as best shown in FIG. 2. Each of the teeth 41 has a substantially planar tooth surface projected from the principal surface of the main plate 11. The belts 40 are periodically driven in the forward sense by another driver (not shown) in synchronism with the successive supply of the cards as will presently be described.

A lever 14 is protruded from the end plate 13 so as to sense a pressure developed by the cards successively fed onto the base member 10 between the end plate 13 and the guide plate 50. The lever is mechanically coupled to a microswitch (not shown). The microswitch, having a make contact, cooperates with the driver which is used to drive the belts 40, in order to electrically control the driver. More particularly, the belts 40 are moved by a predetermined distance by the use of the driver each time when a predetermined number of cards are forced by the card feeder 30 between the end plate 13 and the guide plate 50.

The guide plate 50 is slidably coupled to a guide bar 15 through a bearing 16 which is slidable along the guide bar 15. The guide bar 15 extends parallel to the predetermined direction. Accordingly, the guide plate 50 is not only slidable in the predetermined direction, but also rotatable around an axis of the guide bar 15. The guide plate 50 is perpendicularly placed on the belt 40 with a lower edge portion thereof positioned between two adjacent ones of the teeth 41, as shown in FIG. 2.

In operation, the guide plate 50 is placed at a starting point of the belt 40. The starting point is near the end plate 13 so that a stacking space is formed between the end plate 13 and the guide plate 50. The cards are successively fed into the stacking space by the card feeder 30. When the stacking space is filled with the stacked cards 20, the lever 14 closes the make contact of the microswitch. The endless conveyor belts 40 are moved by the predetermined distance in the conveying sense. The stacking space is expanded by the movement of the endless conveyor belts 40.

The lever 14 is returned back to a former position to electrically disconnect the make contact and deenergize the driver. The endless conveyor belts 40 are stopped by disconnection of the lever 14 from the driver. Similar operation is repeated until the endless conveyor belts 40 become filled with the cards 20 from and end of the endless conveyor belts 40 to another end thereof.

Thus, the belts 40 collectively serve as a conveyor for conveying the stacked cards in the conveying sense. Each tooth 41 of the belts 40 serves as a supporting member for vertically holding the guide plate 50 and prevents each lower edge portion of the stacked cards 20 from sliding in a sense opposite to the conveying sense. However, it is difficult to take the stacked cards out of the illustrated card item stacker because the stacked cards 20 are not slidable in both senses of the predetermined direction. Therefore, the stacked cards 20 must be lifted up on taking the cards out of the card item stacker.

Figure 3:
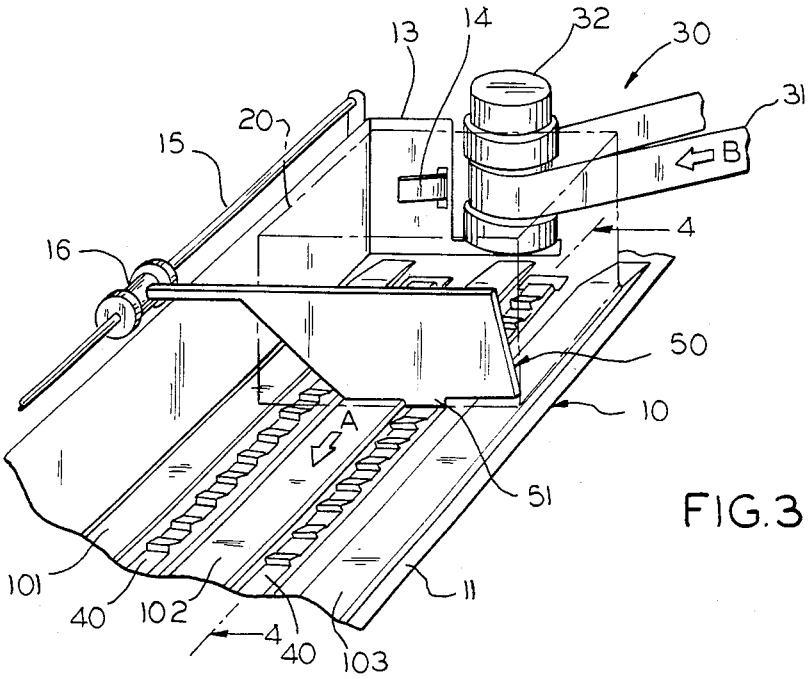
FIG. 3 is a perspective view of a card item stacker according to a preferred embodiment of this invention.
Figure 4:
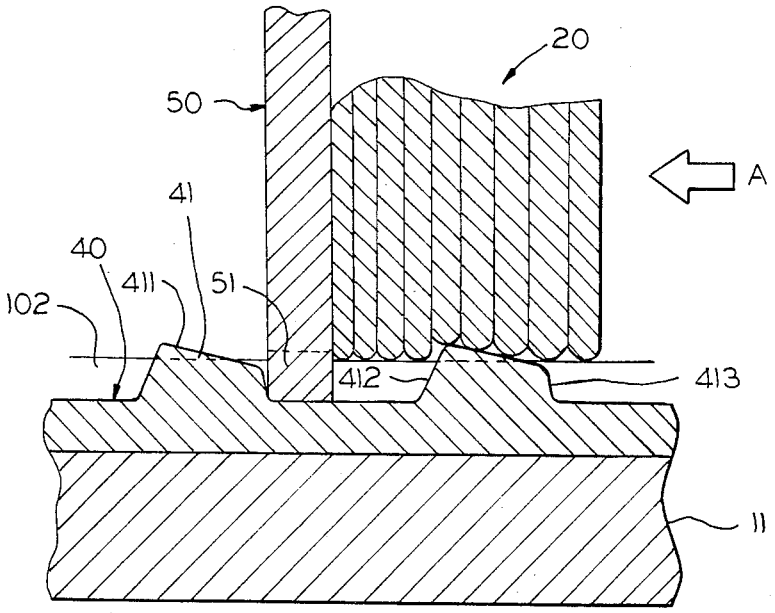
FIG. 4 is an enlarged vertical sectional view taken along a line 4—4 in FIG. 3.

Referring to FIGS. 3 and 4, a card item stacker according to a preferred embodiment of this invention comprises similar parts designated by like reference numerals. The illustrated base member 10 comprises longitudinal plates 101, 102, and 103 laid along the belts 40 and having coplanar surfaces which define a common principal surface. As in the prior-art card item stacker, the teeth 41 are projected outwardly of each belt 40. Each tooth 41 has a tooth surface 411 having first and second end portions 412 and 413 transversely of the predetermined direction. The first end portion 412 leads the second end portion 413 in the conveying sense indicated by the arrow A and is more protruded than the second end portion 413. In contrast to the prior-art card item stacker in which the tooth surface is wholly protruded from the principal surface, the tooth surface 411 is protruded only at least partly from the principal surface. More particularly, the first end portion 412 is protruded from the principal surface of the longitudinal plates 101, 102, and 103. In the example being illustrated, the second end portion 413 is not protruded from the principal surface. The first and the second end portions 412 and 413 define a plane having a slope selected between 5° and 30° relative to the principal surface of the main plate 11. Preferably, the slope is 11°.

The guide plate 50 has a lower edge portion comprising a protrusion 51 and two continuous portions on both sides of the protrusion 51. Among the edge portion, the protrusion 51 alone is positioned between two adjacent ones of the teeth 41 when the guide plate 50 is moved around the horizontal guide bar 15 towards the base member 10. When the belts 40 are fed in the conveying sense, the protrusion 51 is urged by the stacked cards to one of the two adjacent ones of the teeth 41. The continuous portions are slidably received by the longitudinal members 102 and 103, respectively.

Stacking operation of the card item stacker is similar to that of the conventional card item stacker illustrated in conjunction with FIGS. 1 and 2. The guide plate 50 is placed on the belt 40 with the protrusion 51 positioned between two adjacent ones of the teeth 41 as shown in FIG. 4. The guide plate 50 stands upright as shown in FIG. 4. Accordingly, the stacked cards 20 are held substantially vertically on the longitudinal plates 101, 102, and 103 by the guide plate 50. Furthermore, the first end portions 412 protruded from the longitudinal plates 101, 102, and 103 prevent each lower edge portions of the stacked cards 20 from sliding in the sense opposite to the conveying sense.

When the endless conveyor belts 40 are filled with the cards 20 from one end of the endless conveyor belts 40 to another end thereof, the guide plate 50 is manually rotated away from the base member 10 around the guide bar 15. If desired, the guide plate 50 may be returned back to the starting point of the belt 40. When the cards 20 are manually moved in the conveying sense, the lower edge portions of the stacked cards are disengaged from the teeth 41. Accordingly, all of the stacked cards are slidable in the conveying senses. Thus, all of the stacked cards can be readily taken out by sliding the stacked cards in the conveying sense without lifting up the stacked cards.

As thus far been described, the card item stacker according to this invention can readily take the stacked cards out of the stacker. Accordingly, an operation efficiency can be improved.

While this invention has thus far been described in conjunction with a preferred embodiment thereof, it will readily be possible for those skilled in the art to put this invention into practice in various other manners. For example, the second end portion 413 may be formed so as to protrude or retract from the surface of the longitudinal plate 101, 102, and 103. A shape of the protusion 51 and the vertical section of the longitudinal plates 101, 102, and 103 are voluntarily selectable.

What is claimed is:

1. In a card item stacker comprising a base member having a substantially horizontal and upwardly directed principal surface, a first conveyor for successively supplying card items onto said principal surface with each card item directed substantially vertically, a second conveyor comprising an endless belt and teeth which have substantially planar tooth surfaces which are spaced apart on said endless belt and are movable parallel to said principal surface with the tooth surface at least partly projected upwardly from said principal surface, a guide plate which has an edge portion and is guided along a horizontal axis above said principal surface to be movable around said horizontal axis until said edge portion is positioned between two adjacent ones of said teeth, and means for feeding said endless belt so that the teeth having the tooth surfaces projected at least partly upwardly from said principal surface move in a predetermined sense to urge the card items to said guide plate and to make the card items form a stack of the card items received by cooperation of said principal surface and the tooth surfaces of the teeth moving in said predetermined sense, the improvement wherein:

said base member comprises a pair of longitudinal members on both sides of said endless belt with said principal surface defined by said longitudinal members above said endless belt;

each of said tooth surfaces having a first and a second end portion, said first end portion leading said second end portion and being more protruded than said second end portion when said endless belt of said second conveyor moves in said predetermined sense; said edge portion comprising a protrusion and two continuous portions on both sides of said protrusion, said protrusion being urged by said stack of card items to one of said two adjacent ones of said teeth with said continuous portions slidably received by said longitudinal members.

2. A card item stacker as claimed in claim 1, wherein said second end portion is not protruded from said principal surface.

3. A card item stacker as claimed in claim 2, wherein said second end portion is retracted from said principal surface.

4. A card item stacker as claimed in claim 1, wherein said first and said second end portions of each tooth surface define a plane having a slope selected between 5° and 30° relative to said principal surface.

5. A card item stacker as claimed in claim 4, wherein each longitudinal member is rectangular in vertical section.

* * * * *